US008580717B2

(12) United States Patent
Sinquin et al.

(10) Patent No.: US 8,580,717 B2
(45) **Date of Patent: *Nov. 12, 2013**

(54) PROCESS FOR MAKING AN OVERBASED, SULFURIZED SALT OF AN ALKYLATED HYDROXYAROMATIC COMPOUND

(75) Inventors: Gilles P. Sinquin, Saint Martin du Manoir (FR); Thomas Francis Buckley, III, El Sobrante, CA (US); Charles Michael Cisson, Walnut Creek, CA (US)

(73) Assignees: Chevron Oronite Company LLC, San Ramon, CA (US); Chevron U.S.A. Inc., San Ramon, CA (US); Chevron Oronite S.A., Cedex (FR)

( * ) Notice: Subject to any disclaimer, the term of this patent is extended or adjusted under 35 U.S.C. 154(b) by 71 days.

This patent is subject to a terminal disclaimer.

(21) Appl. No.: 12/592,379

(22) Filed: Nov. 24, 2009

(65) Prior Publication Data

US 2011/0124539 A1 May 26, 2011

(51) Int. Cl.

| | |
|---|---|
| ***C10M 159/24*** | (2006.01) |
| ***C10M 135/00*** | (2006.01) |
| ***C10M 159/22*** | (2006.01) |
| ***C07C 309/00*** | (2006.01) |

(52) U.S. Cl.
USPC ..... 508/391; 508/567; 508/574; 562/45

(58) Field of Classification Search
USPC ..... 508/567, 574, 391; 562/45
See application file for complete search history.

(56) References Cited

U.S. PATENT DOCUMENTS

| | | | | |
|---|---|---|---|---|
| 3,226,339 | A | 12/1965 | Frilette et al. | |
| 3,236,761 | A | 2/1966 | Rabo et al. | |
| 3,236,762 | A | 2/1966 | Rabo et al. | |
| 3,373,109 | A | 3/1968 | Frilette et al. | |
| 3,620,960 | A | 11/1971 | Kozlowski | |
| 4,202,996 | A | 5/1980 | Hilfman | |
| 4,440,996 | A | 4/1984 | Calvino | |
| 4,710,485 | A | 12/1987 | Miller | |
| 5,082,986 | A | 1/1992 | Miller | |
| 5,244,588 | A * | 9/1993 | Koshima et al. | 508/574 |
| 5,282,958 | A | 2/1994 | Santilli et al. | |
| 5,318,710 | A | 6/1994 | Campbell et al. | |
| 5,320,762 | A | 6/1994 | Campbell et al. | |
| 5,759,966 | A | 6/1998 | Campbell et al. | |
| 6,670,513 | B1 | 12/2003 | Campbell et al. | |
| 6,787,509 | B2 | 9/2004 | Chambard et al. | |
| 2001/0034307 | A1 | 10/2001 | King et al. | |
| 2002/0091069 | A1 | 7/2002 | King et al. | |
| 2009/0112014 | A1 * | 4/2009 | Campbell et al. | 558/55 |
| 2009/0143264 | A1 | 6/2009 | Harrison et al. | |
| 2009/0170737 | A1 * | 7/2009 | Campbell et al. | 508/460 |

FOREIGN PATENT DOCUMENTS

| | | |
|---|---|---|
| EP | 1760135 A2 | 3/2007 |
| EP | 1995229 A2 | 11/2008 |
| EP | 2 095 874 | 9/2009 |

OTHER PUBLICATIONS

International Search Report issued in counterpart International Patent Application No. PCT/US2010/056554.

J. P. Sumpter, "Structural Features of Alkylphenolic Chemicals Associated with Estrogenic Activity", Journal of Biological Chemistry, vol. 272, No. 6, (Feb. 7, 1997), pp. 3280-3288.

European Search Report issued in counterpart application European Patent Application No. 10833771, Apr. 29, 2013.

* cited by examiner

*Primary Examiner* — Cephia D Toomer
*Assistant Examiner* — Vishal Vasisth

(57) ABSTRACT

An overbased, sulfurized salt of at least one alkylated hydroxyaromatic compound, wherein the alkyl substituent of the hydroxyaromatic compound is a residue of at least one isomerized olefin having from about 15 to about 99 wt. % branching is disclosed. The overbased, sulfurized salt of at least one alkylated hydroxyaromatic compound is produced by the process comprising: (a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound; (b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound.

26 Claims, No Drawings

PROCESS FOR MAKING AN OVERBASED, SULFURIZED SALT OF AN ALKYLATED HYDROXYAROMATIC COMPOUND

BACKGROUND OF THE INVENTION

1. Technical Field

The present invention generally relates to processes for making overbased, sulfurized salts of alkylated hydroxyaromatic compounds.

2. Description of the Related Art

Medium to long chain alkyl aromatics are used to make high volume additives and surfactants. Examples of such compounds are alkyl aromatic phenates used in lubricant additives. Phenates are widely used for their detergency and antioxidant properties.

Low molecular weight alkylphenols such as tetrapropenyl phenol (TPP) have been used as a raw material by producers of sulfurized, overbased phenates. When sulfurized, overbased phenates are made generally there is unreacted alkylphenol in the final reaction product. A recent reproductive toxicity study in rats sponsored by the Petroleum Additives Panel of the American Chemistry Counsel shows that in high concentrations unreacted TPP may cause adverse effects in males and female reproductive organs.

To reduce any potential health risks to customers and avoid potential regulatory issues there is a need to reduce the amount of unreacted low molecular weight alkyl hydroxyaromatic compounds in overbased, sulfurized salts of alkylated hydroxyaromatic compounds. Linear olefins are a possible alternative to avoid reproxicity in the derived alkylphenols; however, the linearity of the olefin can lead to poor low temperature properties in lubricating oils containing the derived sulfurized, overbased phenates.

U.S. Pat. No. 5,318,710 discloses a Group II metal overbased sulfurized alkylphenol composition derived from an alkylphenol enriched of a formula wherein the alkyl substituent of the phenol is a straight chain.

U.S. Pat. No. 5,320,762 discloses a Group II metal overbased sulfurized alkylphenate composition derived from an alkylphenol enriched in substantially straight chained alkyls.

U.S. Pat. No. 6,670,513 ("the '513 patent") discloses a process for producing an alkylated, hydroxyl-containing aromatic compound. The '513 patent further discloses that the process involves (a) isomerizing a normal alpha-olefin or mixture of normal alpha-olefins having from about 16 to about 30 carbon atoms in the presence of a first acidic catalyst capable of inducing both olefin isomerization and skeletal isomerization to produce a mixture of isomerized olefins; and (b) alkylating a hydroxyl-containing aromatic compound with said mixture of isomerized olefins in the presence of a second acidic catalyst comprising a sulfonic acid resin catalyst or an acidic clay.

U.S. Patent Application Publication No. 20020091069 discloses an additive produced by a process comprising: (a) isomerizing an olefin using an iron pentacarbonyl catalyst to produce an isomerized olefin; (b) alkylating an oxy benzene with the isomerized olefin to produce an alkyl oxy benzene, wherein the oxy is selected from the group consisting of hydroxy, methoxy, ethoxy, propoxy, butoxy, pentoxy, and hexoxy; (c) sulfonating the alkyl oxy benzene to produce an alkyl oxy benzene sulfonic acid; and (d) overbasing the alkyl oxy benzene sulfonic acid to produce an overbased, alkyl oxy benzene sulfonate having a TBN of at least 200.

It is desirable to provide improved processes for making overbased, sulfurized salts of alkylated hydroxyaromatic compounds.

SUMMARY OF THE INVENTION

In accordance with one embodiment of the present invention, there is provided a process for preparing an overbased, sulfurized salt of at least one alkylated hydroxyaromatic compound, the process comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound.

In accordance with a second embodiment of the present invention, there is provided an overbased, sulfurized salt of at least one alkylated hydroxyaromatic compound, wherein the alkyl substituent of the hydroxyaromatic compound is a residue of at least one isomerized olefin having from about 15 to about 99 wt. % branching, the overbased, sulfurized salt of the at least one alkylated hydroxyaromatic compound being produced by the process comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound.

In accordance with a third embodiment of the present invention, there is provided an additive concentrate comprising a diluent and at least one overbased, sulfurized salt of at least one alkylated hydroxyaromatic compound, wherein the alkyl substituent of the hydroxyaromatic compound is a residue of at least one isomerized olefin having from about 15 to about 99 wt. % branching, the overbased, sulfurized salt of the at least one alkylated hydroxyaromatic compound being produced by the process comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound, wherein the concentrate has a total base number (TBN) of from about 80 to about 450.

In accordance with a fourth embodiment of the present invention, there is provided a lubricating oil composition comprising (i) a major amount of an oil of lubricating viscosity and (ii) at least one overbased, sulfurized salt of at least one alkylated hydroxyaromatic compound, wherein the alkyl substituent of the hydroxyaromatic compound is a residue of at least one isomerized olefin having from about 15 to about 99 wt. % branching, the overbased, sulfurized salt of the at least one alkylated hydroxyaromatic compound being produced by the process comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound.

In accordance with a fifth embodiment of the present invention, there is provided an engine oil comprising (i) a major amount of an oil of lubricating viscosity; and (ii) at least one overbased, sulfurized salt of at least one alkylated hydroxyaromatic compound, wherein the alkyl substituent of the hydroxyaromatic compound is a residue of at least one isomerized olefin having from about 15 to about 99 wt. % branching, the overbased, sulfurized salt of the at least one alkylated hydroxyaromatic compound being produced by the process comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound.

In accordance with a sixth embodiment of the present invention, there is provided a method for lubricating an engine comprising operating the engine with a lubricating oil composition comprising (i) a major amount of an oil of lubricating viscosity; and (ii) at least one overbased, sulfurized salt of at least one alkylated hydroxyaromatic compound, wherein the alkyl substituent of the hydroxyaromatic compound is a residue of at least one isomerized olefin having from about 15 to about 99 wt. % branching, the overbased, sulfurized salt of the at least one alkylated hydroxyaromatic compound being produced by the process comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound.

The overbased, sulfurized salt of the present invention was determined to be substantially free of endocrine disruptive chemicals when the effects were quantified on the potential adverse effects on male and female reproduction, while providing improved additive package and lubricating oil composition compatibility and improved low temperature handling characteristics. Accordingly, the overbased, sulfurized salt of an alkylated hydroxyaromatic compound of the present invention can advantageously be employed in compositions which have reduced or had no endocrine disruption effects when exposed to mammals.

DETAILED DESCRIPTION OF THE PREFERRED EMBODIMENTS

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

Definitions

The term "alkaline earth metal" refers to calcium, barium, magnesium, and strontium.

The term "alkali metal" refers to lithium, sodium, potassium, rubidium, and cesium.

The term "olefins" refers to a class of unsaturated aliphatic hydrocarbons having one or more carbon-carbon double bonds, obtained by a number of processes. Those containing one double bond are called mono-alkenes, and those with two double bonds are called dienes, alkyldienes, or diolefins. Alpha olefins are particularly reactive because the double bond is between the first and second carbons. Examples of alpha olefins include 1-octene and 1-octadecene, which are used as the starting point for medium-biodegradable surfactants. Linear and branched olefins are also included in the definition of olefins.

The term "normal olefins," which include normal alpha olefins, refers to olefins which are straight chain, non-branched hydrocarbons with at least one carbon-carbon double bond present in the chain.

The term "isomerized olefins" refers to olefins obtained by isomerizing olefins. Generally isomerized olefins have double bonds in different positions than the starting olefins from which they are derived, and may also have different characteristics.

The term "lime" refers to calcium hydroxide, also known as slaked lime or hydrated lime.

The term "phenate" means a salt of a phenol.

The term "Total Base Number" or "TBN" refers to the equivalent number of milligrams of KOH needed to neutralize 1 gram of a product. Therefore, a high TBN reflects strongly overbased products and, as a result, a higher base reserve for neutralizing acids. The TBN of a product can be determined by ASTM Standard No. D2896 or equivalent procedure.

All concentrations of materials disclosed in this application, unless otherwise specified, are on an "actives" basis; that is, the concentrations reported do not include, e.g., diluent or unreacted starting materials or intermediates.

In general, an overbased, sulfurized salt of at least one alkylated hydroxyaromatic compound of the present invention is produced by the process comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound Hydroxyaromatic Compounds At least one hydroxyaromatic compound may be used for the alkylation reaction in the present invention. In one embodiment, the at least one hydroxyaromatic compound comprises at least one monocyclic hydroxyaromatic, such as phenol, cresols, xylenols, or mixtures thereof. The at least one hydroxyaromatic compound may also comprise bi-cyclic and poly-cyclic hydroxyaromatic compounds, such as 2-naphthol or 8-hydroxyquinoline. In one embodiment, the at least one hydroxyaromatic compound is phenol.

Sources of Hydroxyaromatic Compounds

The at least one hydroxyaromatic compound employed in the present invention is prepared by methods that are well known in the art.

Normal Alpha-Olefins

The normal alpha-olefins that are isomerized prior to the alkylation of the hydroxyaromatic compounds are normal alpha-olefins or mixtures of normal alpha-olefins having from about 10 to about 40 carbon atoms per molecule. In one embodiment, the normal alpha-olefins or mixtures of normal alpha-olefins have from about 14 to about 30 carbon atoms. In one embodiment, the normal alpha-olefins or mixtures of normal alpha-olefins have from about 16 to about 30 carbon atoms. In one embodiment, the normal alpha-olefins or mixtures of normal alpha-olefins have from about 18 to about 30 carbon atoms. In one embodiment, the normal alpha-olefins or mixtures of normal alpha-olefins have from about 20 to about 28 carbon atoms. In one embodiment, the normal alpha-olefins or mixtures of normal alpha-olefins have from about 18 to about 24 carbon atoms.

Suitable normal alpha-olefins can be so-called "cracked wax" olefins, made by thermal cracking of waxes, or can be oligomerization products of ethylene. Suitable normal alpha-olefins are available commercially e.g. as 1-Tetradecene, 1-Hexadecene, 1-Octadecene, Alpha Olefin C20-24, and Alpha Olefin C26-28 from CPChem, and from Shell as NEODENE.

Olefin Isomerization Catalyst

The catalyst used to isomerize the normal alpha-olefin or mixture of normal alpha-olefins can be any catalyst that is capable of inducing both olefin isomerization and skeletal isomerization in the normal alpha-olefins while leaving the normal alpha-olefins otherwise essentially intact. As used herein, the term "olefin isomerization" refers to movement of the carbon-carbon double bond within the molecule, and the term "skeletal isomerization" refers to rearrangement of the carbon atoms within the molecule. Examples of such catalysts include solid, acidic catalysts comprising at least one metal oxide, and having an average pore size of less than 5.5 Angstroms. In one embodiment, the solid, acidic catalyst comprises a molecular sieve with a one-dimensional pore system. In another embodiment, the catalyst is selected from the group consisting of molecular sieves SM-3, MAPO-11, SAPO-11, SSZ-32, ZSM-23, MAPO-39, SAPO-39, ZSM-22, and SSZ-20. In one embodiment, the molecular sieves are SAPO-11 and SSZ-32. Other possible solid, acidic catalysts useful for isomerization include molecular sieves ZSM-35, SUZ4, NU-23, NU-87, and natural or synthetic ferrierites. These molecular sieves are well known in the art and are discussed in, for example, Rosemarie Szostak's Handbook of Molecular Sieves (New York, Van Nostrand Reinhold, 1992), and U.S. Pat. No. 5,282,958, issued Feb. 1, 1994 to Santilli et al., both of which are hereby incorporated by reference.

The catalyst can be an admixture with at least one Group VIII metal. Group VIII metals correspond to Groups 8, 9, and 10 metals in IUPAC nomenclature. A useful Group VIII metal includes at least one of platinum and palladium, and optionally other catalytically active metals such as molybdenum, nickel, vanadium, tungsten, cobalt, zinc and mixtures thereof. The amount of metal ranges from about 0.01% to about 10% by weight of the catalyst (not counting the weight of the metal). In another embodiment, the amount of metal ranges from about 0.2% to about 5% by weight of the catalyst (not counting the weight of the metal). The techniques of introducing catalytically active metals to the catalyst are disclosed in the literature, and pre-existing metal incorporation techniques and treatment of the catalyst to form an active catalyst such as ion exchange, impregnation or occlusion during preparation of the catalyst are suitable. Such techniques are disclosed in U.S. Pat. Nos. 3,236,761; 3,226,339; 3,236,762; 3,620,960; 3,373,109; 4,202,996; 4,440,996 and 4,710,485 which are incorporated herein by reference.

The "metal" or "active metal" as used herein means one or more metals in the elemental state or in some form such as sulfide, oxide or mixtures thereof. Regardless of the state in which the metallic component actually exists, the concentrations are computed as if they existed in the elemental state.

The catalyst is used in an amount effective to catalyze the isomerization reaction.

Olefin Isomerization Process Conditions

A method of isomerizing the normal alpha-olefin or mixture of normal alpha-olefins involves catalytic isomerization using, for example, a platinum-supported-on-SAPO-11 molecular sieve catalyst to partially isomerize a feed containing the NAO. This and related catalysts are described in U.S. Pat. No. 5,082,986, which is hereby incorporated by reference. For platinum-on-SAPO-11 catalysts, partial isomerization is preferred. Therefore, operating conditions include weight hourly space velocities (WHSV) between about 0.5 and about 10 at temperatures between about 100° C. and about 250° C. In another embodiment, conditions include WHSV's of between about 0.5 and about 5 at temperatures of about 120° C. to about 160° C. In another embodiment, conditions include WHSV's of between about 0.5 and about 3.5 at temperatures of about 120° C. to about 140° C. Lower temperatures result in substantial olefin double bond migration, while higher temperatures result in increased skeletal rearrangement. The process may be conducted in the presence of added hydrogen.

The isomerized olefins contain branched-chain olefins. The branching may occur at a carbon atom that is part of the carbon-carbon double or at a carbon atom that does not form part of the double bond. Examples of the branched-chain olefins include, but are not limited to, the following:

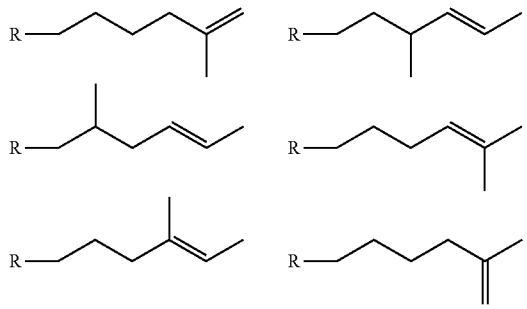

wherein R is the remainder of the olefin. In one embodiment, at least about 15 wt. % of the isomerized olefins are branched. In another embodiment, at least about 30 wt. % of the isomerized olefins are branched. Generally, the resulting isomerized olefins contain about 15 to about 99 wt. % branching. In another embodiment, the resulting isomerized alpha olefins contain about 25 to about 99 wt. % branching. In another embodiment, the resulting isomerized alpha olefins contain about 30 to about 80 wt. % branching. In another embodiment the resulting isomerized alpha olefins contain about 30 to about 60 wt. % branching and are derived from at least one normal alpha-olefin containing from about 14 to 18 carbon atoms. In another embodiment the resulting isomerized alpha olefins contain about 80 to about 99 wt. % branching and are derived from at least one normal alpha-olefin containing from about 20 to 24 carbon atoms.

The use of an alkylated hydroxyaromatic compound wherein the alkyl substituent of the hydroxyaromatic compound is a residue of at least one isomerized olefin having from about 15 to about 99 wt. % branching is advantageous as it has been discovered that the percent branching and the length of the isomerized olefin promotes superior compatibility when used with other common additives and superior low temperature performance when employed as an additive in lubricating oil compositions.

Typically, the alkylated hydroxyaromatic compound comprises a mixture of monosubstituted isomers, the majority of the alkyl substituents being in the para position, less in the ortho position, a minor amount of disubstituted isomers, and hardly any in the meta position. An advantage of this invention is that more of the alkyl attachment is in the para position than is the case for alkylation with normal alpha-olefins, leading to improved ease of reaction to form the overbased, sulfurized salt, especially in the sulfurization step.

Additionally, when the normal alpha olefins do not completely react to form isomerized olefins, residual alpha olefins are obtained. The residual alpha olefins may also react with the hydroxyaromatic compounds to form an alkylated hydroxyaromatic compound having a predominately linear alkyl radical. The alkylated hydroxyaromatic compounds having a linear alkyl radical may comprise a mixture of monosubstituted isomers in which the proportion of linear alkyl substituents in the ortho positions is greater than the para isomer.

In general, the resulting isomerized olefins have less than 20 wt. % residual alpha olefin. In another embodiment, the resulting isomerized alpha olefins have less than 10 wt. % residual alpha olefin. In another embodiment, the resulting isomerized alpha olefins have less than 5 wt. % residual alpha olefin.

In one embodiment, the overbased, sulfurized salt of the at least one alkylated hydroxyaromatic compound will possess an alkyl substitutent on the hydroxyaromatic compound which is a residue of at least one isomerized olefin having from about 15 to about 99 wt. % branching. In another embodiment, the overbased, sulfurized salt of the at least one alkylated hydroxyaromatic compound will possess an alkyl substitutent on the hydroxyaromatic compound which is a residue of the reaction of the hydroxyaromatic compound with at least one isomerized olefin having from about 15 to about 99 wt. % branching.

Olefin Branching Measurement Procedure

Part A: Hydrogenation of Olefins

The amount of branching is measured by adding 2 grams of the olefin into a reacting tube equipped with a magnetic stirrer. Roughly 50 mg of platinum oxide (Adam's catalyst) is added and the tube is placed in a hydrogenator and heated to 50° C. Vacuum is pulled to completely remove any air present in the system. Hydrogen is introduced into the system with a manometer regulating the pressure to roughly 0.4 psig. Agitation is started and the hydrogen consumption monitored using a flowmeter. The reaction is stopped when hydrogen is no longer consumed, typically after 3 to 4 hours. An infrared spectrum of the hydrogenated olefins was taken to verify the disappearance of the peaks at 909 $cm^{-1}$ and 960 $cm^{-1}$ that correspond respectively to the vibration of alpha and trans internal linear olefins. After hydrogenation, all the linear olefins are converted to the corresponding n-alkane. All the branched olefins are converted to the corresponding branched alkanes.

Part B: GC Analysis of Hydrogenated Olefins

The obtained hydrogenated isomerized olefins are analyzed by gas chromatography using an HP 6890 chromatogram equipped with a capillary column (HP-5MS 5% phenyl methyl siloxane capillary 30 m, 0.25 mm internal diameter) and a Flame ionization detector (FID). The temperature profile is adapted to the molecular weight of the hydrogenated olefin being analyzed. Typically, for the heavier molecular weight (20-24 carbons), the initial temperature was 100° C. and heated to 210° C. at 20° C./min and then increased the temperature by 10° C./min to 320° C. The percentage of branching is calculated by integrating all the areas corresponding to the branched alkanes, and dividing by the total of the peak areas. This means, for example, that a mixture of olefins having 0% branching contains no branched compounds; while a mixture of olefins having 100% branching contains only branched compounds.

Alkylation Process Conditions

The alkylation reaction is typically carried out with a hydroxyaromatic compound or mixture of hydroxyaromatic compounds and a mixture of isomerized olefins in a hydroxyaromatic compound:isomerized olefin molar ratio of from about 10:1 to about 1:1. The process temperatures can range from about 40° C. to about 150° C. Since the olefins have a high boiling point, the process is preferably carried out in the liquid phase. The alkylation process may be carried out in batch or continuous mode. In the batch mode, a typical method is to use a stirred autoclave or glass flask which may be heated to the desired reaction temperature. A continuous process is most efficiently carried out in a fixed bed process. Space velocities in a fixed bed process can range from about 0.01 to about 10 or more WHSV.

In a fixed bed process the catalyst is charged to the reactor and activated or dried at a temperature of at least 100° C. under vacuum or flowing inert, dry gas. After activation, the catalyst is cooled to ambient temperature and a flow of the hydroxyaromatic compound is introduced. Optionally, the hydroxyaromatic compound may be added to the catalyst at the reaction temperature. A flow of the isomerized olefin is then mixed with the hydroxyaromatic compound and allowed to flow over the catalyst. The reactor effluent containing the alkylated product and excess hydroxyaromatic compound is collected. Any excess hydroxyaromatic compound can be removed by distillation, stripping, evaporation under vacuum, or other means known to those skilled in the art. One embodiment of the invention employs an alkylation process is that described in European Patent Application 2095874, which employs a specific Y-zeolite catalyst.

Rather than performing the isomerization oneself, it is possible to purchase commercial isomerized olefins that can be used to alkylate the at least one hydroxyaromatic compound. An olefin of this type is Isomerised Alpha Olefin $C_{18}$ available from CP Chem.

Neutralizing, Sulfurizing, and Overbasing

The at least one alkylated hydroxyaromatic compound is subsequently neutralized, sulfurized, and overbased to provide the overbased, sulfurized salt of the at least one alkylated hydroxyaromatic compound. The neutralization and sulfurization steps can be performed in any order so as to provide the overbased, sulfurized salt of the invention; often the neutralization and sulfurization steps are carried out simultaneously.

The quantities of reagents used may correspond to the following equivalent ratios, referred to the total amount of the at least one alkylhydroxyaromatic compound: (1) source of base from about 0.5 to about 4, and preferably from about 1 to about 2;

(2) source of sulfur from about 0.5 to about 4, and preferably from about 1 to about 2; and (3) overbasing compound from about 0.5 to about 4, and preferably from about 1 to about 2.

Neutralization Step

Neutralization of the alkylated hydroxyaromatic compound may be carried out in a continuous or batch process by any method known to a person skilled in the art. Numerous methods are known in the art to neutralize alkylated hydroxyaromatics and to produce basic phenates by incorporation of a source of base. The source of base may be one or a mixture of an alkali metal or alkaline earth metal base. The alkaline earth metal bases that can be used for carrying out this step include the oxides or hydroxides of calcium, magnesium, barium, or strontium, and particularly of calcium oxide, calcium hydroxide, magnesium oxide, and mixtures thereof. In one embodiment, the alkaline earth metal base is slaked lime (calcium hydroxide).

Such processes are typically conducted in a suitable diluent and commonly with other promoters such as diols, e.g. $C_2$ to $C_4$ alkylene glycols, preferably ethylene glycol; and/or high molecular weight alkanols (generally $C_8$ to $C_{16}$, e.g. decyl alcohols, 2-ethyl hexanol); and/or carboxylic acids. The reaction mixture is then heated to reaction temperature for a suitable period of time to form the reaction product; optionally the product is distilled to remove impurities. The dilution oils suitable for use in the above processes include naphthenic oils and mixed oils and preferably paraffinic oils such as 100 neutral oil The quantity of dilution oil used is such that the amount of oil in the final product constitutes from about 25% to about 65% by weight of the final product, preferably from about 30% to about 50%.

In general, the neutralization step is carried out at a temperature ranging from about 20 to about 180° C. In one embodiment, the neutralization step is carried out at a temperature ranging from about 40 to about 110° C.

Sulfurization Step

Any suitable sulfur source can be used for the sulfurization step. Examples of suitable sulfur sources include elemental sulfur, sulfur chloride, sulfur dioxide and sodium sulfide hydrates. The sulfur can be employed either as molten sulfur or as a solid (e.g., powder or particulate) or as a solid suspension in a compatible hydrocarbon liquid.

A suitable promoter can also be used in the sulfurization step. A useful promoter includes a polyol such as an alkylene diol, e.g., ethylene glycol. In conjunction with the promoter or mixture of promoters above, a high molecular weight alkanol can be employed as a co-solvent. These high molecular weight alkanols have straight or branched chain alkyls containing 8 to about 16 carbon atoms, and preferably 9 to about 15 carbon atoms. Representative examples of suitable alkanols include 1-octanol, 1-decanol (decyl alcohol), 2-ethyl-hexanol, and the like. Particularly preferred is 2-ethyl-hexanol. It is beneficial to use a high molecular weight alkanol in the process because it acts as a solvent and also forms an azeotrope with water and hence affords a convenient way to remove the water generated by the neutralization or any other water in the system, by azeotropic distillation either after or preferably during the reaction. The high molecular weight alkanol may also play some part in the chemical reaction mechanism in the sense that it facilitates the removal of the byproduct water during the reaction, thus pushing the reaction to the right of the reaction equation.

The temperature range in which the sulfurization reaction is carried out is generally about 100° C. to about 170° C. In one embodiment, the temperature range is from about 130° C. to about 160° C. The reaction can be conducted under atmospheric pressure (or slightly lower) or at elevated pressures. In one embodiment the reaction is carried out under vacuum. The exact pressure developed during the reaction is dependent upon such factors as the design and operation of the system, the reaction temperature, and the vapor pressure of the reactants and products and it may vary during the course of the reaction. In one embodiment, the process pressures are at atmospheric to about 680 mm Hg.

During sulfurization a significant amount of by-product hydrogen sulfide gas is evolved. This gas may be removed at the end of the sulfurization step or it can be removed continuously as it is formed during the reaction.

Overbasing Step

The overbasing step is done by reaction with an acidic overbasing compound, such as carbon dioxide or boric acid, in the presence of a source of base. The source of base may be one or a mixture of an alkali metal or alkaline earth metal base. The alkaline earth metal bases that can be used for carrying out this step include the oxides or hydroxides of calcium, magnesium, barium, or strontium, and particularly of calcium oxide, calcium hydroxide, magnesium oxide, and mixtures thereof. In one embodiment, the alkaline earth metal base is slaked lime (calcium hydroxide). The source of base may be introduced into the overbasing step as excess base from the neutralization step, or may be added separately in the overbasing step, or both.

A particularly preferred overbasing process is carbonation, i.e., a reaction with carbon dioxide. Such carbonation can be conveniently effected by addition of a polyol, typically an alkylene diol, e.g., ethylene glycol, and carbon dioxide to the sulfurized salt of the alkylated hydroxyaromatic compound. Conveniently, the reaction is conducted by the simple expedient of bubbling gaseous carbon dioxide through the reaction mixture. Excess diluent and any water formed during the overbasing reaction can be conveniently removed by distillation either during or after the reaction. In one embodiment the source of base and the overbasing compound are added in portions.

Additive Concentrate

In another embodiment of the invention, the overbased, sulfurized salts of the present invention may be provided as an additive package or concentrate in which the additive is incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will also typically contain one or more of the various other additives, referred to above, in the desired amounts and ratios to facilitate direct combination with the requisite amount of base oil.

In one embodiment, the resulting additive concentrate will have a total base number (TBN) of about 80 to about 450. In another embodiment, the resulting additive concentrate will have a TBN of about 105 to about 300. In another embodiment the resulting additive concentrate will have a TBN of about 200 to about 280.

Lubricating Oil Composition

Another embodiment of the present invention is directed to a lubricating oil composition containing at least (a) an oil of lubricating viscosity; and (b) at least one overbased, sulfurized salt of at least one alkylated hydroxyaromatic compound of the present invention, which is useful as a lubricating oil additive. The lubricating oil compositions can be prepared by admixing, through conventional techniques, an appropriate amount of the lubricating oil additive of this invention with a base oil of lubricating viscosity. The selection of the particular base oil depends on the contemplated application of the lubricant and the presence of other additives. Generally, the amount of the overbased sulfurized salt of at least one alkylated hydroxyaromatic compound of this invention will vary from about 0.1 wt. % to about 20 wt. %, based on the total weight of the lubricating oil composition. In one embodiment the overbased sulfurized salt of at least one alkylated hydroxyaromatic compound of this invention will vary from about 0.1 wt. % to about 2 wt. %, based on the total weight of the lubricating oil composition.

The oil of lubricating viscosity for use in the lubricating oil compositions of this invention, also referred to as a base oil, is typically present in a major amount, e.g., an amount of greater than 50 wt. %, preferably greater than about 70 wt. %, more preferably from about 80 to about 99.5 wt. % and most preferably from about 80 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. For example, the base oils can be used in formulating lubricating oil compositions for any and all such applications such as passenger car engine oils, heavy duty diesel motor oils and natural gas engine oils. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30 or 15W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof, alkylbenzenes such as dodecylbenzenes, tetradecylbenzenes, dinonylbenzenes, di(2-ethylhexyl)-benzenes, and the like, polyphenyls such as biphenyls, terphenyls, alkylated polyphenyls, and the like, alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils includes, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500 to 1000, diethyl ether of polypropylene glycol having a molecular weight of 1,000 to 1,500, etc.) or mono- and polycarboxylic esters thereof such as, for example, the acetic esters, mixed $C_3$-$C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorus containing acids, e.g., tricresyl phosphate, trioctyl phosphate, diethyl ester of decane phosphionic acid, etc., polymeric tetrahydrofurans, and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The lubricating oil compositions of the present invention may also contain other conventional additives for imparting auxiliary functions to give a finished lubricating oil composition in which these additives are dispersed or dissolved. For example, the lubricating oil compositions can be blended with antioxidants, anti-wear agents, detergents such as metal detergents, rust inhibitors, dehazing agents, demulsifying agents, metal deactivating agents, friction modifiers, pour point depressants, antifoaming agents, co-solvents, package compatibilisers, corrosion-inhibitors, ashless dispersants, dyes, extreme pressure agents and the like and mixtures thereof A variety of the additives are known and commercially available. These additives, or their analogous compounds, can be employed for the preparation of the lubricating oil compositions of the invention by the usual blending procedures.

Examples of antioxidants include, but are not limited to, aminic types, e.g., diphenylamine, phenyl-alpha-napthylamine, N,N-di(alkylphenyl) amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof.

Examples of antiwear agents include, but are not limited to, zinc dialkyldithiophosphates and zinc diaryldithiophosphates, e.g., those described in an article by Born et al. entitled "Relationship between Chemical Structure and Effectiveness of Some Metallic Dialkyl- and Diaryl-dithiophosphates in Different Lubricated Mechanisms", appearing in Lubrication Science 4-2 Jan. 1992, see, for example, pages 97-100; aryl phosphates and phosphites, sulfur-containing esters, phosphosulfur compounds, metal or ash-free dithiocarbamates, xanthates, alkyl sulfides and the like and mixtures thereof.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof. The amount of the rust inhibitor may vary from about 0.01 wt. % to about 10 wt. %

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof. The amount of the friction modifier may vary from about 0.01 wt. % to about 10 wt. %

Examples of antifoaming agents include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or amides of dodecylsuccinic acid, phosphate esters, thiophosphates, alkyl imidazolines, sarcosines and the like and combinations thereof. The amount of the corrosion inhibitor may vary from about 0.01 wt. % to about 5 wt. %.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about 0.01 wt. % to about 5 wt. %.

The applications to which the lubricating oil compositions of this invention may be put are not particularly limited, and include e.g. marine cylinder lubricants, trunk piston engine oils, and system oils; automotive engine oils; railroad engine oils; stationary engine oils such as natural gas engine oils; greases; and functional fluids such as tractor hydraulic fluids, gear oils, antiwear hydraulic oils, and transmission fluids. However, the exceptional low temperature properties of the salt of the invention make it especially useful in engine oils, such as railroad engine oils, passenger car motor oils, light duty diesel engine oils, and heavy duty diesel engine oils. Accordingly, an embodiment of this invention is a method for operating an engine comprising lubricating the engine with a lubricating oil composition containing the overbased, sulfurized salt of the alkylated hydroxyaromatic compound of the invention.

The following non-limiting examples are illustrative of the present invention.

EXAMPLE 1

1-Tetradecene available from CP Chem (Chevron Phillips Chemical Company, Woodland Tex.) was isomerized using a crystalline zeolite SSZ-32, N-lower alkyl-N-isopropyl imidazolium cation as template, isomerization catalyst. This and similar catalysts are described in U.S. Pat. No. 5,053,373. The isomerization process was carried out at a temperature between 150° C. and 200° C. As olefins tend to have high boiling points, the process was performed in the liquid phase and in a fixed-bed process. In the fixed-bed process, space rates, measure the rates of contact between the reactants and the catalyst beds that ranged from 0.5 to 2 $h^{-1}$ WHSV (weight hourly space velocity). The catalyst was charged into the reactor and heated to the desired reaction temperature. It was also possible to heat the olefin before it was exposed to the catalyst bed. An exotherm of about 10° C. to 15° C. was often observed along the catalyst bed. The reactor effluent containing partially-branched and isomerized olefin was then collected.

The level of isomerization was achieved through the conditions chosen for the feed rate and inlet temperature. The level of isomerization was typically characterized by the level of branching in a particular olefin sample or mixture. The branching level of isomerized olefin of this example was measured as 50.5%.

EXAMPLE 2

The isomerized olefin of Example 1 and phenol were added to a 4 liter ground flask in a 1:4 total charge mole ratio. The products were mixed together and heated to 80° C. Amberlyst® 36 sulfonic acid ion exchange resins available from Rohm and Hass at 12 weight percent (wt. %) of the olefin charge was added to the reaction. The reaction was heated to 130° C. and held under nitrogen for 5 hours at this temperature and atmospheric pressure. Afterwards, the reaction mixture was cooled down to 100° C. and filtered to remove the catalyst. The reaction mixture was vamped up to 230° C. under roughly 30 mmHg and held for about 15 minutes to distillate the excess phenol. The resulting alkylated phenol composition was as follows:

Mono alkylphenol as 91.1 wt. % with 39.9 wt. % ortho and 52.0 wt. % para; dialkylphenols as 4.8 wt. %; unreacted olefin dimers as 2.9 wt. %; unreacted olefins as 0.4 wt. %; ethers as 0.7 wt. % and phenol as 0.1 wt. %.

Next, 914.8 grams of the alkylated phenol composition was combined with 324.7 grams of 130N oil, 35.3 grams of an alkylaryl sulfonic acid, and 0.2 grams of foam inhibitor S1200 available from Dow Corning and charged in a 4 liter flask at ambient temperature. The mixture was warmed over 25 minutes to 110° C., and while warming 304 grams of hydrated lime was added. After the warming phase and after lime addition was completed, 90.2 grams of sulfur were added and the reaction temperature was increased to 150° C. over 20 minutes. After the sulfur addition phase, the pressure of the reactor was reduced to 680 mmHg. $H_2S$ gas that was produced during the sulfurization was trapped by two caustic soda bubblers. At 155° C., 46.6 grams of ethylene glycol was added over 45 minutes and the mixture was heated to 170° C. Over a 30 minute period, 393.6 grams of 2-ethylhexanol was added, cooling the reaction to 162° C. The reaction was allowed to heat back up to 170° C., at which point 76.4 grams of ethylene glycol was added over a period of one hour.

Following the ethylene glycol addition, the pressure was slightly increased to 720 mmHg and reaction conditions were maintained for 20 minutes. Maintaining the temperature at 170° C., the pressure was increased to 760 mmHg. Once at atmospheric pressure, 9 grams of carbon dioxide were added over 30 minutes. After the addition of carbon dioxide, 63.4 grams of ethylene glycol were added over one hour and the rate of $CO_2$ was increased to 0.8 g/minute. This carbonation step was stopped when roughly 100 grams of $CO_2$ was added.

Over a one hour period, the solvent was distilled at 215° C. and 30 mmHg. The temperature was then further increased to 220° C. with a nitrogen purge at 80 mmHg over the course of an hour. The product was filtered with celite at 165° C. and the filtered phenate was degassed under air over four hours at 5 liter/hour/kg of product at 150° C. The product had 9.36% Ca; 3.01% S; 9.5% unreacted alkylphenol and a kinematic viscosity at 100° C. of 41.3 cSt. The TBN was not measured directly, but can be estimated by multiplying the Ca content in wt-% by 28, and so is estimated to be about 260 mg KOH/g.

EXAMPLE 3

A $C_{14}$ isomerized olefin was prepared in substantially the same manner as in Example 1, except that the isomerization level was further increased. The branching level of the isomerized olefin was measured as 82.1%.

EXAMPLE 4

An alkylated phenol and alkylated phenate were prepared in substantially the same manner as in Example 2 using the isomerized olefin of Example 3. The resulting alkylated phenol composition was as follows:

Mono alkylphenol as 93.3 wt. % with 29.7 wt. % ortho and 53.6 wt. % para; dialkylphenols as 3.6 wt. %; unreacted olefin dimers as 10.1 wt. %; unreacted olefins as 1.2 wt. %; ethers as 0.9 wt. % and phenol as 0.4 wt. %.

The resulting product calcium content was 9.4%, 3.03% of sulfur, 5.0% unreacted alkylphenol and had a kinematic viscosity at 100° C. of 66.2 cSt. The estimated TBN was about 260 mg KOH/g.

EXAMPLE 5

An isomerized olefin was prepared in substantially the same manner as in Example 1, except that 1-Hexadecene available from CP Chem was isomerized. The branching level of the isomerized olefin was measured as 96.2%.

EXAMPLE 6

An alkylated phenol and alkylated phenate were prepared in substantially the same manner as in Example 2 using the isomerized olefin of Example 5. The resulting alkylated phenol composition was as follows:

Mono alkylphenol as 72.3 wt. % with 17.2 wt. % ortho and 55.1 wt. % para; dialkylphenols as 1.7 wt. %; unreacted olefin dimers as 16.8 wt. %; unreacted olefins as 5.9 wt. %; ethers as 1.0 wt. % and phenol as 1.1 wt. %.

The resulting product calcium content was 9.47%, 3.05% of sulfur; 3.9% unreacted alkylphenol and had a kinematic viscosity at 100° C. of 73.0 cSt. The estimated TBN was about 265 mg KOH/g.

EXAMPLE 7

An alkylated phenol and alkylated phenate were prepared in substantially the same manner as in Example 2 using an Isomerised Alpha Olefin $C_{18}$ available from CP Chem with a branching level measured as 34.8%. The resulting alkylated phenol composition was as follows:

Mono alkylphenol as 92.7 wt. % with 46.8 wt. % ortho and 45.9 wt. % para; dialkylphenols as 5.9 wt. %; unreacted olefin dimers as 0.0 wt. %; unreacted olefins as 0.3 wt. %; ethers as 0.4 wt. % and phenol as 0.6 wt. %.

The resulting product calcium content was 9.35%, 2.88% of sulfur; 17.5% unreacted alkylphenol and had a kinematic viscosity at 100° C. of 49.1 cSt. The estimated TBN was about 260 mg KOH/g.

EXAMPLE 8

An isomerized olefin was prepared in substantially the same manner as in Example 1, except that 1-Octadecene available from CP Chem was isomerized. The branching level of the isomerized olefin was measured as 96.9%.

EXAMPLE 9

An alkylated phenol and alkylated phenate were prepared in substantially the same manner as in Example 2 using the isomerized olefin of Example 8. The resulting alkylated phenol composition was as follows:

Mono alkylphenol as 80.4 wt. % with 21.5 wt. % ortho and 58.9 wt. % para; dialkylphenols as 2.6 wt. %; unreacted olefin dimers as 8.9 wt. %; unreacted olefins as 6.0 wt. %; ethers as 1.0 wt. % and phenol as 1.0 wt. %.

The resulting product calcium content was 9.49%, 3.04% of Sulfur; 5.0% unreacted alkylphenol and had a kinematic viscosity at 100° C. of 89.0 cSt. The estimated TBN was about 265 mg KOH/g.

EXAMPLE 10

An isomerized olefin was prepared in substantially the same manner as in Example 1, except that Alpha Olefin $C_{20-24}$ available from CP Chem was isomerized. The branching level of the isomerized olefin was measured as 25.9%.

EXAMPLE 11

An alkylated phenol and alkylated phenate were prepared in substantially the same manner as in Example 2 using the isomerized olefin of Example 10. The resulting alkylated phenol composition was as follows:

Mono alkylphenol as 92.7 wt. % with 48.2 wt. % ortho and 44.5 wt. % para; dialkylphenols as 4.4 wt. %; unreacted olefin dimers as 0.0 wt. %; unreacted olefins as 1.4 wt. %; ethers as 1.2 wt. % and phenol as 0.3 wt. %.

The resulting product calcium content was 8.98%; 2.76% of sulfur; 15.7% unreacted alkylphenol and had a kinematic viscosity at 100° C. of 78.2 cSt. The estimated TBN was about 250 mg KOH/g.

EXAMPLE 12

An isomerized olefin was prepared in substantially the same manner as in Example 1, except that Alpha Olefin $C_{20-24}$ available from CP Chem was isomerized. The branching level of the isomerized olefin was measured as 96.1%.

EXAMPLE 13

An alkylated phenol and alkylated phenate were prepared in substantially the same manner as in Example 2 using the isomerized olefin of Example 12. The resulting alkylated phenol composition was as follows:

Mono alkylphenol as 91.89 wt. % with 17.64 wt. % ortho and 74.25 wt. % para; dialkylphenols as 3.15 wt. %; unreacted olefin dimers as 0.0 wt. %; unreacted olefins as 3.81 wt. %; ethers as 0.74 wt. % and phenol as 0.37 wt. %.

The resulting product calcium content was 9.23%; 3.11% of sulfur; 7.3% unreacted alkylphenol and had a kinematic viscosity at 100° C. of 187.0 cSt. The estimated TBN was about 260 mg KOH/g.

COMPARATIVE EXAMPLE A

An alkylated phenol and alkylated phenate were prepared in substantially the same manner as in Example 2 using a propylene tetramer available from Chevron Oronite. The branching level of the isomerized olefin was not measured but is assumed to be 100% based on the structure of this olefin. The resulting alkylated phenol composition was as follows:

The alkylated phenol had the following composition:

Mono alkylphenol as 95.71 wt. % with 7.53 wt. % ortho and 88.14 wt. % para; dialkylphenols as 2.33 wt. %; unreacted olefin dimers as 0.00 wt. %; unreacted olefins as 1.12 wt. %; ethers as 0.31 wt. % and phenol as 0.53 wt. %.

The resulting product calcium content was 9.66%; 3.41% of sulfur, 8.2% unreacted alkylphenol and had a kinematic viscosity at 100° C. of 319 cSt. The estimated TBN was about 270 mg KOH/g.

COMPARATIVE EXAMPLE B

An alkylated phenol and alkylated phenate were prepared in substantially the same manner as in Example 2 using 1-Tetradecene available from CP Chem. The 1-Tetradecene was not isomerized. The branching level of this normal olefin was measured at 5.3%. The resulting alkylated phenol composition was as follows:

Mono alkylphenol as 94.90 wt. % with 57.38 wt. % ortho and 37.52 wt. % para; dialkylphenols as 3.94 wt. %; unreacted olefin dimers as 0.0 wt. %; unreacted olefins as 0.08 wt. %; ethers as 0.79 wt. % and phenol as 0.29 wt. %.

The resulting product calcium content was 9.49%; 2.47% sulfur; 14.5% unreacted alkylphenol and had a kinematic viscosity at 100° C. of 38.4 cSt. The estimated TBN was about 265 mg KOH/g.

COMPARATIVE EXAMPLE C

An alkylated phenol and alkylated phenate were prepared in substantially the same manner as in Example 2 using 1-Hexadecene available from CP Chem. The 1-Hexadecene was not isomerized. The branching level of this normal olefin was measured at 6.4%. The resulting alkylated phenol composition was as follows:

Mono alkylphenol as 94.10 wt. % with 55.85 wt. % ortho and 38.25 wt. % para; dialkylphenols as 4.55 wt. %; unreacted olefin dimers as 0.00 wt. %; unreacted olefins as 0.18 wt. %; ethers as 0.92 wt. % and phenol as 0.25 wt. %.

The resulting product calcium content was 9.35%; 2.69% sulfur; 17.1% unreacted alkylphenol and had a kinematic viscosity at 100° C. of 43.8 cSt. The estimated TBN was about 260 mg KOH/g.

COMPARATIVE EXAMPLE D

An alkylated phenol and alkylated phenate were prepared in substantially the same manner as in Example 2 using 1-Octadecene available from CP Chem. The 1-Octadecene was not isomerized. The branching level of this normal olefin was measured at 8.0%. The resulting alkylated phenol composition was as follows:

Mono alkylphenol as 91.08 wt. % with 5.38 wt. % ortho and 35.70 wt. % para; dialkylphenols as 4.22 wt. %; unreacted olefin dimers as 0.00 wt. %; unreacted olefins as 2.30 wt. %; ethers as 2.11 wt. % and phenol as 0.29 wt. %.

The resulting product calcium content was 9.25%, 2.59% sulfur; 17.5% unreacted alkylphenol and had a kinematic viscosity at 100° C. of 43.8 cSt. The estimated TBN was about 260 mg KOH/g.

COMPARATIVE EXAMPLE E

An alkylated phenol and alkylated phenate were prepared in substantially the same manner as in Example 2 using Alpha Olefin $C_{20-24}$ available from CP Chem. The Alpha Olefin $C_{20-24}$ was not isomerized. The branching level of this normal olefin was measured at 12.8%. The resulting alkylated phenol composition was as follows:

Mono alkylphenol as 90.08 wt. % with 53.29 wt. % ortho and 36.89 wt. % para; dialkylphenols as 4.87 wt. %; unreacted olefin dimers as 0.00 wt. %; unreacted olefins as 2.26 wt. %; ethers as 2.17 wt. % and phenol as 0.52 wt. %.

The resulting product calcium content was 9.28%; 2.56% sulfur; 17.5% unreacted alkylphenol and had a kinematic viscosity at 100° C. of 87.7 cSt. The estimated TBN was about 260 mg KOH/g.

Additive Package Compatibility Evaluation

To demonstrate the performance of the overbased, sulfurized salts of the alkylated hydroxyaromatic compounds of the present invention, the compatibility of the overbased, sulfurized salts of the alkylated hydroxyaromatic compounds of Examples 2, 4, 6, 7, 9, 11 and 13 (within the scope of the present invention) were evaluated against the overbased, sulfurized salts of the alkylated hydroxyaromatic compounds of Comparative Examples A-E (outside the scope of the invention) in a baseline additive package formulation I.

The baseline additive package formulation I contained (a) 35.2 wt. % of an oil concentrate of a ethylene carbonate-treated bis-succinimide dispersant derived from 2300 MW polybutene; (b) 10.6 wt. % of an oil concentrate of a low overbased calcium sulfonate;

(c) 13.4 wt. % of an oil concentrate of a secondary zinc dithiophosphate anti-wear agent; (d) 1.7 wt. % of an oil concentrate of a molybdenum oxysulfide complex of a succinimide dispersant derived from 1000 MW polybutene; (e) 3.11 wt. % of a borated glycerol mono-oleate friction modifier; (f) 0.05 wt. % of a foam inhibitor; and (g) balance 150N base oil.

Each of the reaction products of Examples 2, 4, 6, 7, 9, 11 and 13 and of Comparative Examples A-E were added to the baseline additive package formulation I at the concentrations shown in Table 1 and subjected to the following compatibility test.

Additive Package Compatibility Test

This test evaluates the tendency of an additive package to form sediments, flocculation or gel over time. The additive package was poured into a glass flask and stored at 20° C. To test the compatibility of the package at 80° C., packages were exposed to the following daily heating cycle: 80° C. for 8 hours and 14 hours at 20° C. The samples were visually inspected every week and a final rating was given after 28 days. The rating was given as follows:

0=free of sediment

1=hazy but no sediment

2=sediment present

3=gelled

Compatibility ratings after 28 days are set forth in Table 1.

TABLE 1

| Example | Product Amount, Wt. % | Olefin Carbon Length | Olefin Structure | Branching, Wt-% | Compatibility at 20° C. | Compatibility at 80° C. |
|---|---|---|---|---|---|---|
| Comp. Ex. A | 23.6 | 12 | Propylene based | 100 | 0 | 0 |
| Example 2 | 24.4 | 14 | Isomerized | 50.5 | 0 | 0 |
| Example 4 | 24.3 | 14 | Isomerized | 82.1 | 0 | 0 |
| Comp. Ex. B | 24.1 | 14 | Normal | 5.3 | 3 | 0 |
| Example 6 | 24.1 | 16 | Isomerized | 96.2 | 0 | 0 |
| Comp. Ex. C | 24.4 | 16 | Normal | 6.4 | 3 | 0 |
| Example 7 | 24.4 | 18 | Isomerized | 34.8 | 0 | 0 |
| Example 9 | 24.1 | 18 | Isomerized | 96.9 | 0 | 0 |
| Comp. Ex. D | 24.7 | 18 | Normal | 8.0 | 0 | 0 |
| Example 11 | 25.4 | 20-24 | Isomerized | 25.9 | 0 | 0 |
| Example 13 | 24.7 | 20-24 | Isomerized | 96.1 | 0 | 0 |
| Comp. Ex. E | 24.6 | 20-24 | Normal | 12.8 | 0 | 2 |

0 = free of sediment
1 = hazy
2 = sediment present
3 = gelled

The results show that a lubricating additive package containing a phenate derived from an isomerized olefin (>15 wt. % branching) exhibits relatively improved compatibility when compared to a similar additive package containing a phenate derived from a linear olefin (<15 wt-% branching).

In order to further demonstrate the improved compatibility of the salts of the invention, the compatibility of an additive package of one of the reaction products of Examples 2, 4, 6, 7, 9, 11 and 13 and of Comparative Examples A-E were combined individually within an additive package with a high overbased sulfonate on an equal calcium basis; that is, each package contained 100 millimoles of calcium per kg of additive package from the phenate and 100 millimoles of calcium per kg of additive package from the sulfonate and evaluated, according to the above additive package compatibility test.

Compatibility ratings after 28 days are set forth in Table 2.

TABLE 2

| Example | Product Amount, Wt. % | Olefin Carbon Length | Olefin Structure | Branching, Wt-% | Compatibility at 20° C. | Compatibility at 80° C. |
|---|---|---|---|---|---|---|
| Comp. Ex. A | 4.14 | 12 | Propylene based | 100 | 0 | 0 |
| Example 2 | 4.27 | 14 | Isomerized | 50.5 | 1 | 0 |
| Example 4 | 4.26 | 14 | Isomerized | 82.1 | 0 | 0 |
| Comp. Ex. B | 4.21 | 14 | Normal | 5.3 | 0 | 2 |
| Example 6 | 4.22 | 16 | Isomerized | 96.2 | 0 | 0 |
| Comp. Ex. C | 4.28 | 16 | Normal | 6.4 | 0 | 2 |
| Example 7 | 4.28 | 18 | Isomerized | 34.8 | 0 | 0 |
| Example 9 | 4.21 | 18 | Isomerized | 96.9 | 0 | 0 |
| Comp. Ex. D | 4.32 | 18 | Normal | 8.0 | 0 | 2 |
| Example 11 | 4.45 | 20-24 | Isomerized | 25.9 | 0 | 0 |
| Example 13 | 4.33 | 20-24 | Isomerized | 96.1 | 0 | 0 |
| Comp. Ex. E | 4.31 | 20-24 | Normal | 12.8 | 0 | 2 |

0 = free of sediment
1 = hazy
2 = sediment present
3 = gelled

As the data show, additive packages containing a phenate derived from an isomerized olefin exhibit surprisingly improved compatibility when compared to similar additive packages containing a phenate derived from a linear olefin, especially at higher temperature.

Lubricating Oil Composition Low Temperature Evaluation

The low temperature viscosity properties of lubricants containing the products of Examples 2, 4, 6, 7, 9, 11 and 13 (within the scope of the present invention) were compared to those of lubricants containing the products of Comparative Examples A-E (outside the scope of the invention) in both 5W30 and 5W40 baseline lubricating oils. Each baseline lubricating oil contained (a) 3 wt. % of an oil concentrate of a borated bis-succinimide dispersant derived from 1300 MW polybutene; (b) 5 wt. % of an oil concentrate of a ethylene carbonate-treated bis-succinimide dispersant derived from 2300 MW polybutene; (c) 1.36 wt. % of an oil concentrate of a low overbased calcium sulfonate; (d) 0.4 wt. % of an oil concentrate of a salt of terephthalic acid and a bis-succinimide derived from 1300 MW polybutene; (e) 1.08 wt. % of an oil concentrate of a secondary zinc dithiophosphate anti-wear agent; (f) 0.4 wt. % of an oil concentrate of a molybdenum oxysulfide complex of a monosuccinimde dispersant derived from 1000 MW polybutene; (g) 0.5 wt. % of an alkylated diphenylamine oxidation inhibitor; (h) 0.5 wt. % of a phenolic antioxidant (available from Ciba Specialty Chemicals as IRGANOX® L-135); (i) 30 ppm of a foam inhibitor; and (j) the balance being base oil. The reaction products of Examples 2, 4, 6, 7, 9, 11 and 13 and of Comparative Examples A-E were added to the baseline lubricating oil on an equal calcium basis at the concentrations shown in Table 3, and the low temperature properties of the finished lubricant was evaluated using the ASTM D4684 Mini-Rotary Viscometer (MRV) test.

ASTM D4684 Mini-Rotary Viscometer Test

In this test, a test oil is first heated, and then cooled to test temperature, in this case −35° C., in a mini-rotary viscometer cell. Each cell contains a calibrated rotor-stator set, in which the rotor is rotated by means of a string wound around the rotor shaft and attached to a weight. A series of increasing weights are applied to the string starting with a 10 g weight until rotation occurs to determine the yield stress. Results are reported as Yield Stress as<the applied force in Pascals. A 150 g weight is then applied to determine the apparent viscosity of the oil. The larger the apparent viscosity, the more likely it is that the oil will not be continuously and adequately supplied to the oil pump inlet. Results are reported as Viscosity in centipoise.

The results of the MRV test for each of the lubricating oil compositions are set forth below in Table 3.

TABLE 3

| Example | Olefin Carbon Length | Branching, Wt-% | Product Amount, Wt. % | 5W30 Yield Stress, Pa | 5W30 Viscosity, cP | 5W40 Yield Stress, Pa | 5W40 Viscosity, cP |
|---|---|---|---|---|---|---|---|
| Comp. Ex. A | 12 | 100 | 2.32 | <35 | 19000 | <175 | 108000 |
| Example 2 | 14 | 50.5 | 2.40 | <35 | 16800 | <35 | 38900 |
| Example 4 | 14 | 82.1 | 2.39 | <35 | 18600 | <105 | 199000 |
| Comp. Ex. B | 14 | 5.3 | 2.37 | <35 | 16200 | <70 | 48300 |
| Example 6 | 16 | 96.2 | 2.37 | <35 | 18500 | <70 | 40300 |

TABLE 3-continued

| Example | Olefin Carbon Length | Branching, Wt-% | Product Amount, Wt. % | 5W30 Yield Stress, Pa | 5W30 Viscosity, cP | 5W40 Yield Stress, Pa | 5W40 Viscosity, cP |
|---|---|---|---|---|---|---|---|
| Comp. Ex. C | 16 | 6.4 | 2.40 | <35 | 16000 | <140 | 68900 |
| Example 7 | 18 | 34.8 | 2.40 | <35 | 16600 | <35 | 31600 |
| Example 9 | 18 | 96.9 | 2.37 | <35 | 18500 | <140 | 72300 |
| Comp. Ex. D | 18 | 8.0 | 2.43 | <70 | 24600 | <175 | 53900 |
| Example 11 | 20-24 | 25.9 | 2.50 | <105 | 31200 | <175 | 56200 |
| Example 13 | 20-24 | 96.1 | 2.43 | <35 | 19000 | <210 | 167000 |
| Comp. Ex. E | 20-24 | 12.8 | 2.42 | <140 | 40700 | <280 | 135000 |

The results in Table 3 demonstrate that yield stresses and viscosities for lubricants containing phenates derived from olefins having greater than 15 wt-% branching are generally lower, and therefore more desirable, than yield stresses and viscosities for lubricants containing phenates derived from olefins having less than 15 wt-% branching, for a given carbon length. This is especially the case for olefin carbon numbers of 16 and greater.

Reproductive Toxicity Screening Study of Alkylphenols

The alkylated hydroxyaromatic compounds of Examples 2 and 9 and Comparative Examples A-C underwent a study to obtain a preliminary data on potential adverse effect on male and female reproduction. The studies were carried out according to the OECD 421 reproductive toxicity screening study protocol. In this test, a group of 12 rats of each sex in the parental (F0) generation are administered daily oral (gavage) dose levels as shown in Table 4 of the test alkylphenol. The dosing volume was 5 ml/kg/day. Control animals received the vehicle only, which was a peanut oil dosing solution prepared weekly, and their test material concentrations, homogeneity and stability verified by chemical analysis. Male and female parental animals were dosed daily during the pre-mating (28 days), mating (up to 15 days), gestation (up to 25 days) and lactation (4 days) periods until necropsy.

F0 animals were paired within their groups on a 1:1 basis for mating. Females were examined daily during mating for presence of a copulatory plug or sperm in the vagina. When evidence of mating was not detected within 10 days, the female was placed for up to 5 days with another male from the same group that had previously mated. At completion of parturition, litters were examined for viability. Data for the fertility index (number of females that became pregnant/number of females mated), ovary weight (g), female liver weight (g), and female kidney weight (g) are set forth below in Table 4. Results differing significantly from the results for the control group may indicate potential adverse effects.

TABLE 4

Reproductive toxicity screening study

| Alkylphenol Sample | Olefin Carbon Length | Olefin Structure | Alkylphenol Treat Rate mg/kg/day | Fertility Index | Ovaries Weight, g | Female Liver Weight, g | Female Kidney Weight, g |
|---|---|---|---|---|---|---|---|
| Control | | | 0 | 100% | 0.1622 | 13.06 | 2.22 |
| Comparative Example A | 12 | Propylene based | 125 | 13% | 0.1135** | 10.7** | 1.90** |
| Example 2 | 14 | Isomerized | 375 | 100% | 0.1581 | 17.21** | 2.55** |
| Comparative Example B | 14 | Normal | 375 | 100% | 0.1687 | 17.85** | 2.50** |
| Example 9 | 20-24 | Isomerized | 1000 | 92% | 0.1405** | 14.16 | 2.13 |
| Comparative Example C | 20-24 | Normal | 1000 | 92% | 0.1457 | 15.97** | 2.15 |

*Significant at >95% probability
**Significant at >99% probability

All of the alkylphenols of Table 4 exhibit a large decrease in reproductive toxicity effects compared to the alkylphenol of Comparative Example A derived from propylene tetramer. The alkylphenols derived from normal and isomerized $C_{14}$ olefins, however, exhibit systemic toxic effects (as indicated by the high liver and kidney weights) at relatively low dosages, preventing the collection of reproductive toxicity data at higher treat rates. In contrast, the alkylphenol derived from a mixture of normal $C_{20}$ to $C_{24}$ olefins had much smaller systemic toxicity at a much higher dosage, while the alkylphenol derived from isomerized $C_{20}$ to $C_{24}$ had no significant systemic toxicity at a much higher dosage. The alkylphenols derived from both normal and isomerized $C_{20}$ to $C_{24}$ olefins both showed minor reproductive toxicity effects at much higher dosage. The data clearly show the reduced reproductive and systemic toxicity effects of alkylphenols derived from $C_{20}$ to $C_{24}$ olefins as compared with alkylphenols derived from lower molecular weight olefins.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A process for preparing an overbased, sulfurized salt of at least one alkylated hydroxyaromatic compound, the process comprising:

(a) alkylating at least one hydroxyaromatic compound with at least one isomerized olefin having from about 15 to about 99 wt % branching obtained by isomerizing at least one normal alpha olefin having from about 10 to about 40 carbon atoms, to provide at least one alkylated hydroxyaromatic compound;

(b) neutralizing and sulfurizing the alkylated hydroxyaromatic compound in any order to provide at least one neutralized, sulfurized alkylated hydroxyaromatic compound; and (c) overbasing the at least one neutralized, sulfurized alkylated hydroxyaromatic compound; wherein the hydroxyaromatic compound is a phenol, cresol, xylenol, or a mixture thereof.

2. The process for preparing the overhased, sulfurized salt of at least one alkylated hydroxyaromatic compound of claim 1, comprising:

(a) alkylating at least one hydroxyaromatic compound with at least one isomerized olefin having from about 15 to about 99 wt, % branching obtained by isomerizing at least one normal alpha olefin having from about 10 to about 40 carbon atoms, to provide at least one alkylated hydroxyaromaic compound;

(b) simultaneously neutralizing and sulfurizing the resulting alkylated hydroxyaromatic compound with a mixture of a base and a source of sulfur to provide a sulfurized salt of the alkylated hydroxyaromatic compound; and (c) overbasing the sulfurized salt of the alkylated hydroxyaromatic compound with an overbasing acid.

3. The process for preparing the overbased, sulfurized salt of at least one alkylated hydroxyaromatic compound of claim 1, comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) neutralizing the resulting alkylated hydroxyaromatic compound with a base to provide a salt of the alkylated hydroxyaromatic compound;

(c) sulfurizing the salt of the alkylated hydroxyaromatic compound with a source of sulfur to provide a sulfurized salt of the alkylated hydroxyaromatic compound; and (d) overbasing the sulfurized salt of the alkylated hydroxyaromatic compound with an overbasing acid.

4. The process for preparing the overbased, sulfurized salt of at east one alkylated hydroxyaromatic compound of claim 1, comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) sulfurizing the alkylated hydroxyaromatic compound with a source of sulfur to provide a sulfurized alkylated hydroxyaromatic compound;

(c) neutralizing the resulting sulfurized alkylated hydroxyaromatic compound with a base to provide a sulfurized salt of the alkylated hydroxyaromatic compound; and (d) overbasing the sulfurized salt of the alkylated hydroxyaromatic compound with an overbasing acid.

5. The process for preparing the overbased, sulfurized salt of at least one alkylated hydroxyaromatic compound of claim 1, wherein the isomerized olefin has from about 25 to about 99 wt. % branching.

6. The process for preparing the overbased, sulfurized salt of at least one alkylated hydroxyaromatic compound of claim 1, wherein the isomerized olefin has from about 30 to about 80 wt. % branching.

7. The process for preparing the overbased, sulfurized salt of at least one alkylated hydroxyaromatic compound of claim 1, wherein the at least one normal alpha olefin has from about 16 to about 30 carbon atoms.

8. The process for preparing the overbased, sulfurized salt of at least one alkylated hydroxyaromatic compound of claim 1, wherein the hydroxyaromatic compound is phenol.

9. The process for preparing the overbased, sulfurized salt of at least one alkylated hydroxyaromatic compound of claim 1, wherein the base is a source of alkali metal or alkaline earth metal.

10. The process for preparing the overbased, sulfurized salt of at least one alkylated hydroxyaromatic compound of claim 9, wherein the base is a source of calcium.

11. The process for preparing the overbased, sulfurized salt of at least one alkylated hydroxyaromatic compound of claim 1, wherein the overbasing acid is carbon dioxide.

12. An overbased, sulfurized salt of at least one alkylated hydroxyaromatic compound, wherein the alkyl substitutent of the hydroxyaromatic compound is a residue of at least one isomerized olefin having from about 15 to about 99 wt. % branching, the overbased, sulfurized salt of the at least one alkylated hydroxyaromatic compound being produced by the process comprising:

(a) alkylating at least one hydroxyaromatic compound with at least one isomerized olefin having from about 15 to about 99 wt. % branching obtained by isomerizing at least one normal alpha olefin having from about 10 to about 40 carbon atoms, to provide at least one alkylated hydroxyaromatic compound;

(b) neutralizing and sulfurizing the aikylated hydroxyaromatic compound in any order to provide at least one neutralized, sulfurized alkylated hydroxyaromatic compound; and (c) overbasing the at least one neutralized, sulfurized alkylated hydroxyaromatic compound to provide the overbased, suifurized salt; wherein the hydroxyaromatic compound is a phenol, cresol, xylenol, or a mixture thereof.

13. The overbased, sulfurized salt of at least one alkylated hydroxyaromatic compound of claim 12, wherein the isomerized olefin has from about 25 to about 99 wt. % branching.

14. The overbased, sulfurized salt of at least one alkylated hydroxyaromatic compound of claim 12, wherein the isomerized olefin has from about 30 to about 80 wt % branching.

15. The overbased, sulfurized salt of at least one alkylated hydroxyaromatic compound of claim 12, wherein the at least one normal alpha olefin has from about 16 to about 30 carbon atoms.

16. The overbased, sulfurized salt of at least one alkylated hydroxyaromatic compound of claim 12, wherein the hydroxyaromatic compound is a phenol.

17. The overbased, sulfurized salt of at least one alkylated hydroxyaromatic compound of claim 12, wherein the base is a source of alkali metal or alkaline earth metal.

18. The overbased, sulfurized salt of at least one alkylated hydroxyaromatic compound of claim 17, wherein the base is a source of calcium.

19. The overbased, sulfurized salt of at least one alkylated hydroxyaromatic compound of claim 12, wherein the overbasing acid is carbon dioxide.

20. An additive concentrate comprising a diluent and at least one of the overbased, sulfurized salt of at least one alkylated hydroxyaromatic compound of claim 12, wherein the additive concentrate has a total base number (TBN) of from about 80 to about 450.

21. A lubricating oil composition comprising (a) a major amount of an oil of lubricating viscosity and (b) at least one of the overbased, sulfurized salt of at least one alkylated hydroxyaromatic compound of claim 12.

22. The lubricating oil composition of claim 21, wherein the overbased, sulfurized salt is present in an amount of about 0.1 wt. % to about 20 wt. %, based on the total weight of the composition.

23. The lubricating oil composition of claim 21, further comprising at least one additive selected from the group consisting of an antioxidant, anti-wear agent, detergent, rust inhibitor, dehazing agent, demulsifying agent, metal deactivating agent, friction modifier, pour point depressant, anti-foaming agent, co-solvent, package compatibiliser, corrosion-inhibitor, ashless dispersant, dye, extreme pressure agent and mixtures thereof.

24. The lubricating oil composition of claim 21, wherein the lubricating oil composition is an engine oil.

25. A method for lubricating an engine comprising operating the engine with the lubricating oil composition of claim 21.

26. A method for reducing the endocrine disrupting properties of a lubricating oil composition on exposure to mammals, the method comprising adding the overbased, sulfurized salt of at least one alkylated hydroxyaromatic compound of claim 12 to a lubricating oil composition comprising a major amount of an oil of lubricating viscosity.

* * * * *